United States Patent [19]

Poldervaart et al.

[11] Patent Number: 4,694,771

[45] Date of Patent: Sep. 22, 1987

[54] MOORING DEVICE

[75] Inventors: Leendert Poldervaart, La Turbie; Jean C. M. Personnat, Nice, both of France

[73] Assignee: Single Buoy Moorings Inc., Marly, Switzerland

[21] Appl. No.: 811,400

[22] Filed: Dec. 20, 1985

[30] Foreign Application Priority Data

Dec. 31, 1984 [NL] Netherlands ..... 8403978

[51] Int. Cl.[4] ..... B63B 21/00

[52] U.S. Cl. ..... 114/230; 441/3

[58] Field of Search ..... 114/219, 230; 441/3, 441/4, 5; 405/211, 212

[56] References Cited

U.S. PATENT DOCUMENTS

| | | | |
|---|---|---|---|
| 3,901,040 | 8/1975 | Sandberg . | |
| 4,029,039 | 6/1977 | Van Heijst | 114/230 |
| 4,098,212 | 7/1978 | Kemper et al. | 114/230 |
| 4,262,380 | 4/1981 | Foolen | 114/230 X |

FOREIGN PATENT DOCUMENTS

| | | | |
|---|---|---|---|
| 0105976 | 4/1984 | European Pat. Off. . | |
| 1041426 | 10/1958 | Fed. Rep. of Germany . | |
| 7614397 | 7/1977 | Netherlands . | |
| 2019800 | 11/1979 | United Kingdom | 441/5 |

*Primary Examiner*—Jeffrey V. Nase
*Assistant Examiner*—Paul E. Salmon
*Attorney, Agent, or Firm*—Young & Thompson

[57] ABSTRACT

Mooring device comprising a body at a distance above the bottom of a body of water such as a tower positioned upon the bottom of the water. The tower carries a downwardly extending construction loaded by a weight which construction can pivot about a vertical axis at the top of the tower and about a horizontal axis and at its lower end has been connected with a floating device such as a vessel by one or more rigid arms. The point of connection of the rigid arms with the weight loaded construction is located beyond the vertical axis of the tower seen in a direction away from the floating device.

9 Claims, 13 Drawing Figures

MOORING DEVICE

BACKGROUND OF THE INVENTION

The invention relates to a mooring device comprising a body provided at a distance above the bottom of the body of water and by means of connecting means having a substantially fixed location with respect to said bottom of the body of water, which body may be a tower placed upon the water bottom, a column swingably connected by its lower end to the water bottom and having buoyancy or a buoy anchored by means of chains, which body has been provided with a support rotatable about a vertical axis which carries swingably about a horizontal axis a weight loaded construction which has been connected to a connecting member which can be loaded at least in tension and which can be attached or has been attached respectively to a floating device such as a vessel.

Such a mooring device is known from e.g. the French patent specification No. 2,420,475 or the European patent application No. 0 105 976. Mooring devices of the known type function like a spring present between the floating device and the body, which spring with increasing load becomes more rigid.

With mooring devices one has to deal with the so called "main forces" resulting from the forces exerted by wind and current on the vessel as well as from forces resulting from the waves. Said forces, depending on their magnitude, cause a certain displacement of the floating device away from the body to which the device has been moored.

Wave forces, however, also cause movements, e.g. a slow movement with low frequency upon which are superimposed movements of high frequency which are related to the wave frequency. The slow movements are dependent on the own frequency of the floating device.

Said movements make it necessary that the floating device, such as a tanker, under the occurring loads resulting from wind, currents and waves remain capable of performing movements.

The known mooring device has the disadvantage that with an increase of the load the action of the spring becomes more rigid and therewith the freedom becomes restricted to perform the movements. The floating device very often is a tanker having such a mass that it will move at any rate under the influence of the occurring forces and this has the result that the connecting members and parts of the mooring device become overloaded and thus damaged.

SUMMARY OF THE INVENTION

The invention aims at providing a solution for this and according to the invention this is achieved in a very simple way in that the connecting member has been connected to the weight-loaded construction at a point or at points which, seen in a direction away from the floating device is or respectively are located beyond the vertical axis of the support from which the construction is suspended. The location of the connecting point according to the invention at a place which, seen from the floating device, lies beyond the center of gravity of the weight-loaded construction, surprisingly has as a result that with increase of the load the action of the spring primarily decreases, thereby at the right moment offering a larger freedom of movement.

Preferably the body is formed by a tower. The construction may be formed by a body, such as a ring surrounding the tower, and said ring seen from above may have any shape such as circular, polygonal, rectangular etc.

The construction also may be an open U-shape or horse shoe with the opening turned away from the floating device. Said embodiment has the advantage that the construction cannot come into conflict with the tower on the side thereof opposite the floating device.

It is preferred that the construction at the side turned towards the floating device is loaded heavier than at the other side.

Preferably the connecting member is rigid arm. This can be a single arm, but it is possible as well to use two arms which independently from each other are pivotably connected to the floating device and to the construction. This is desirable in view of the swinging movements of the vessel about its longitudinal axis.

Two separate rigid arms are known as such from European application No. 0 105 976.

In a preferred embodiment according to the invention the support may have two pivot shafts extending in opposite directions each of which carries a construction with a weight and each construction at the point located beyond the axial axis being connected with the floating device by means of its own connecting member and said construction and connecting members may pivot independently of each other. Said pivot connection with a horizontal axis ensures that the downwardly suspended constructions can swing only in planes parallel to the vertical axis of the body. The connection of said constructions with the rigid arms then preferably comprises a universal pivot.

It is observed that from the earlier cited European application No. 0 105 976 a tower is known having a support rotatable about a vertical axis which on opposite sides of the tower carries two constructions formed by tubes and having at the lower end a weight, the suspension, however, being formed by a universal joint.

In the above described preferred embodiment conflict between the rigid arms and that part of the constructions carrying the weight has to be avoided. According to the invention this can be achieved in that each construction is formed by a space frame which starting from the plane of the suspension at the support has a portion carrying the weight as well as a portion engaged by the arm, which portions are located in planes parallel to the pivot shaft and spaced apart such that the pivotal movements of the arm with respect to the construction remain free from the weight and the weight supporting part. Weight and arm accordingly are present in separate planes.

In case the suspension of the construction takes place by means of chains and the support is made in the form of a ring the stable position of the construction with respect to the tower may be obtained by suspending the construction by means of at least three flexible members extending in different directions such as chains or pivotably connected rods.

A construction is feasible as well, however, in which the rigid arm has only a pivot connection about a horizontal axis with the floating device as well as parallel to it a pivot connection with a horizontal axis with the construction embodied in the form of a closed ring which construction is suspended from the support by means of pivotable or flexible members located in a vertical plane through the vertical axis of the support and through the centers of the pivotal connections of the arm with the floating device and the construction respectively. By means of the suspension with pivotable or flexible members in the central longitudinal plane of the mooring device one ensures that the construction itself can follow the swinging movements of the vessel about its longitudinal axis due to the pivotal connections with horizontal axis.

BRIEF DESCRIPTION OF THE DRAWINGS

The invention now will be further elucidated with reference to the drawings.

DETAILED DESCRIPTION OF THE INVENTION

Figure 1:
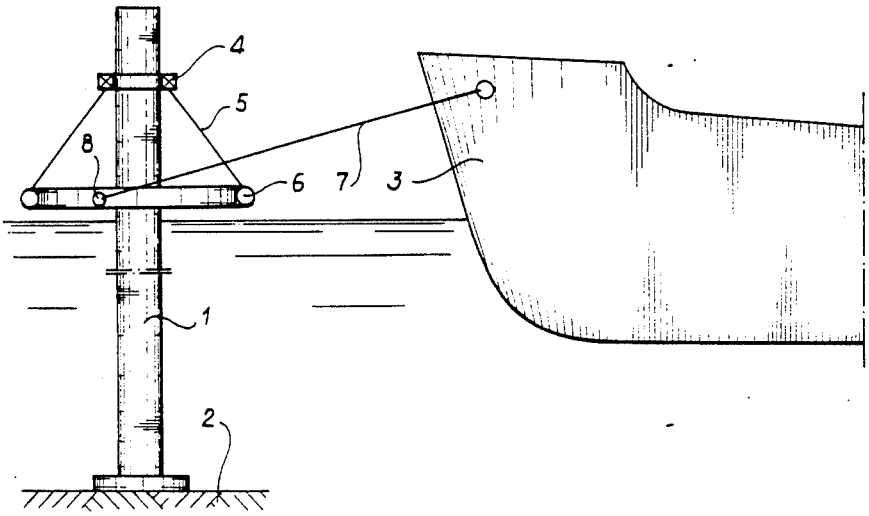
FIG. 1 shows diagrammatically in side view an embodiment of the mooring device according to the invention.

FIG. 1 shows a tower 1 rigidly mounted upon the seabottom 2. A tanker 3 is moored to the tower. To this end the tower has been provided with a ring 4 rotatable about the vertical axis of the tower which ring supports with at least three cables 5 a ring 6 which surrounds the tower and which can be loaded in its entirety, e.g. in that the ring is formed by a circular curved hollow body filled with concrete.

The ring 6 is shown above water, but of course also can be located below water. Such a ring can function as a fender and to this end reference is made to the non-prepublished Dutch patent application No. 8302024.

Figure 2:
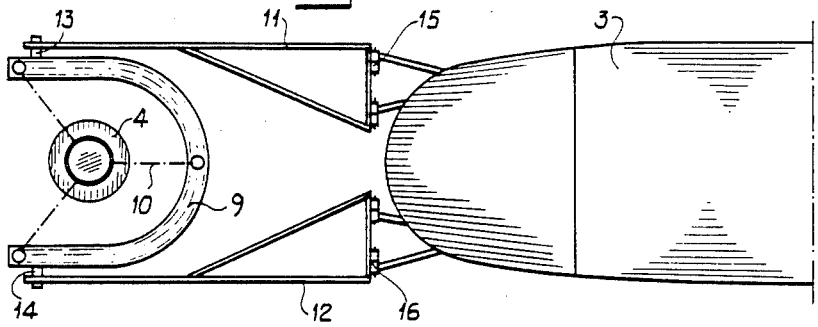
FIG. 2 shows in top view an alternative.

According to the invention the tanker has been connected with the ring 6 by means of a connection 7 which can be loaded by tension and which has been connected to the ring at a location or locations 8 lying beyond the vertical axis of the ring 4 or the tower 1 respectively. The connecting member 7 can be formed by cables but preferably is formed by a rigid arm, which possibility is shown in the embodiment of FIG. 2 which in top view shows that the construction comprises an open U 9, which again with cables or rods 10 has been swingably suspended from a ring 4.

The connecting member now comprises two rigid arms 11 and 12, which at 13 and 14 respectively are connected to the construction 9 at locations lying beyond the axis of rotation of the ring 4 and therewith beyond the point of suspension and which at 15 and 16 respectively are pivotably connected about a horizontal transverse axis to the tanker 3.

Figure 3:
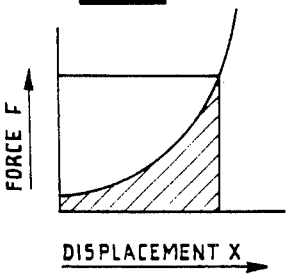
fig-3 PRIOR ART
FIGS. 3 and 4 are diagrams which serve to elucidate the principle.
Figure 4:
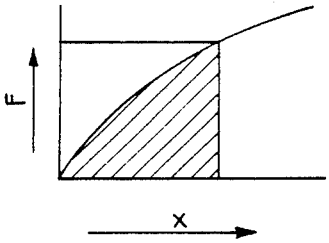

In the FIGS. 3 and 4 a diagram is shown which on the horizontal axis with X indicates the displacement of the construction 6 or 9 respectively and along the vertical axis with F the forces which occur in the connecting member 7, 11, 12 respectively under the influence of the forces operating on the tanker.

FIG. 3 shows a force-displacement diagram according to the known situation with the connecting member engaging at the center of gravity of the weight. In FIG. 1 this accordingly would mean at the location of the vertical axis or on the right side of it as shown in FIG. 1 of French specification 2,420,475.

The diagram in FIG. 3 shows that with increase of the load the spring becomes more rigid.

FIG. 4 shows the situation which occurs if the point of connection according to the invention is placed beyond the center of gravity. One can see from it that with low forces and still small displacements the spring is relatively rigid, but that, with increase of the load the rigidity decreases due to which the freedom of movement for the unavoidable movements increases and therewith the danger of disadvantageous load decreases.

Figure 5:
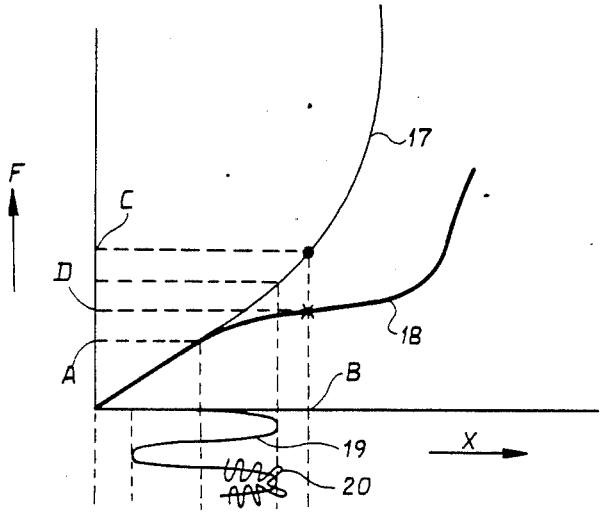
FIG. 5 is a diagram which clearly shows the difference between the known devices and the invention.

FIG. 5 shows a comparable diagram and indicates with the curve 17 in which way for a certain case the operation of the spring changes. The curve 18 indicates what in that case the change will be if the invention is applied.

In this diagram at "A" on the vertical axis has been indicated a load level for the main forces. These are the forces resulting from wind, current and waves.

Below the horizontal axis with line 19 has been indicated the path of movements of the slow motion upon which has been superimposed according to line 20 the movement with high frequency.

If said movements lead to a maximum deviation at B on the X-axis then the diagram of FIG. 5 teaches that with the known mooring device this would lead to a load level at the level of point C, whereas according to the invention this would lead to a load level only at the level of point D which is much lower.

Figure 7:
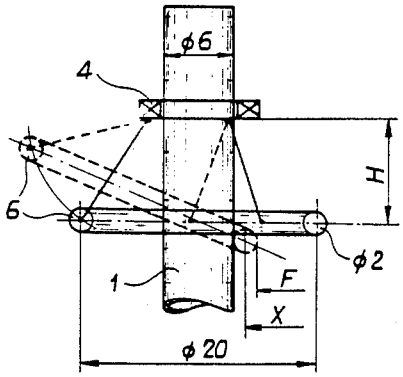
FIG. 7 serves to elucidate FIG. 6.

In FIG. 7 the tower 1 of FIG. 1 has been shown diagrammatically with suspended from it a weight loaded ring 6. The height between the point 4 of suspension and the ring 6 has been indicated by H, the force causing a displacement by F and the distance of the displacement by X. The point of engagement of the force F is on the ring itself as indicated in FIG. 7.

The diameter of the ring is 20 meters, the thickness of the ring is 2 meters and the diameter of the tower 6 meters.

Figure 6:
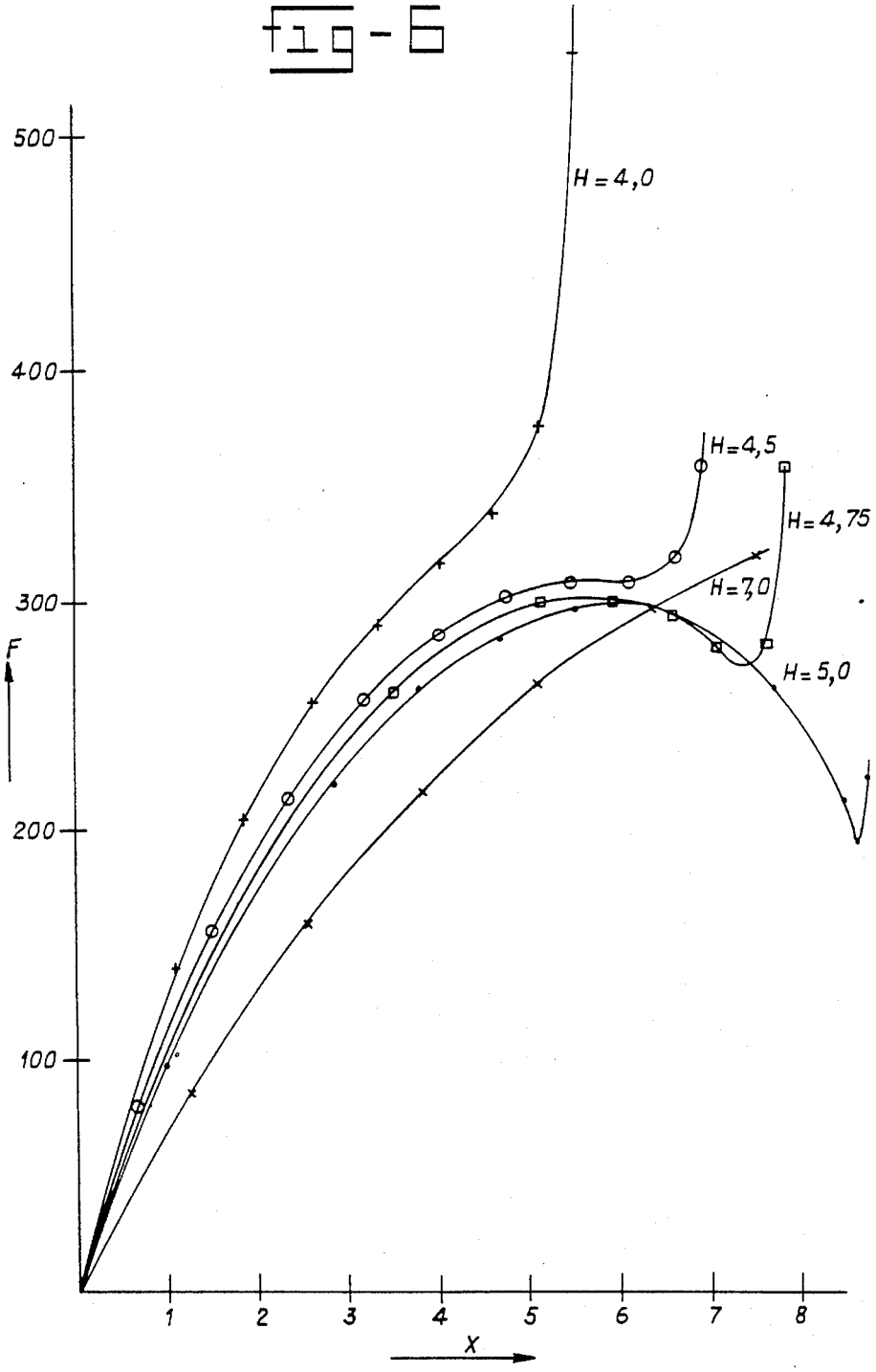
FIG. 6 is a diagram relating to a number of possible embodiments.

FIG. 6 shows a number of curves which are different depending on the height H. At H is 4 meters the initially weakening spring quickly becomes rigid again and this takes places at a stroke of about 4 meters.

At H is 4.5 meters, this takes place only with a stroke of 6 meters. This also takes place when H is 4.74 meters with a stroke of 7.25 meters and when H=5 meters with a stroke of 8.5 meters. With a height of 7 meters the point of reversal of curvature has not been shown in the diagram. The heights of 5 meters and more are not interesting for the described embodiment because with the application of a ring this ring will engage the tower with a displacement of 6 meters. If a U-shaped construction is used then a vertical displacement is certainly possible.

It is of importance to note that this diagram teaches that the height of the suspension also plays a role.

This follows from the comparison of the moments. The weight of the ring shown at the location of the center of gravity, always has a component with an arm up to the point of suspension. In the starting position said component is zero and with increase of the stroke it grows theoretically up to infinity.

The line of application of the force F, between the ship and the point of connection of the ship to the ring, has a distance to the point 4 of suspension which changes. The force F multiplied by this distance form the counter moment which has to be in equilibrium with the moment of the weight component multiplied by the distance to the point of suspension of the weights.

As pointed out above, the length of the distance of the line of the force F to the point of suspension does change. With increase of the load said length first increases and thereafter, due to the fact that said line passes the point of gravity decreases again. This explains the reversal in the diagrams.

Figure 8:
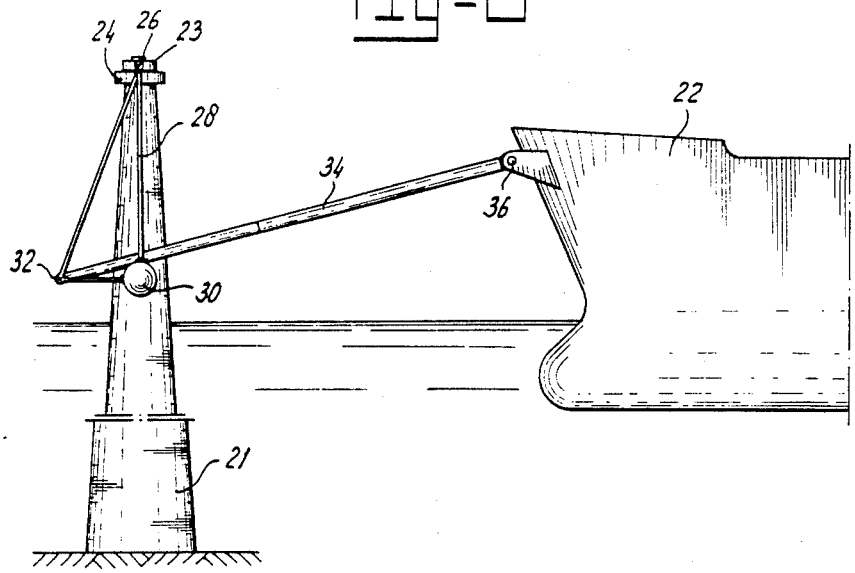
FIG. 8 is a side view of the principle of another embodiment.
Figure 9:
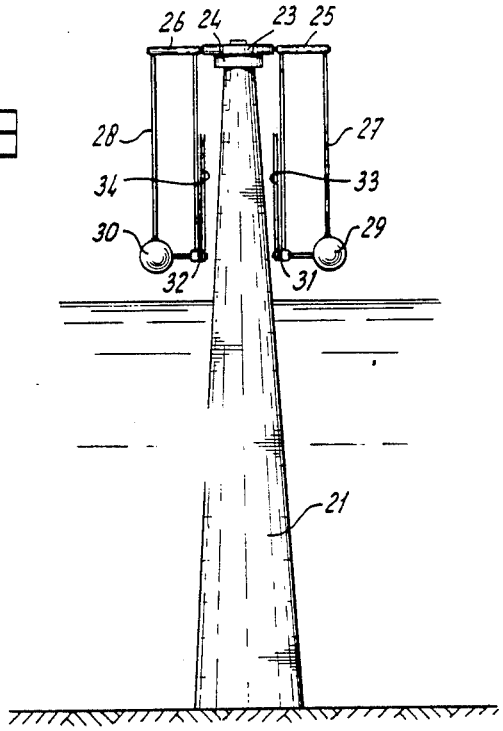
FIG. 9 is a front view of FIG. 8.
Figure 10:
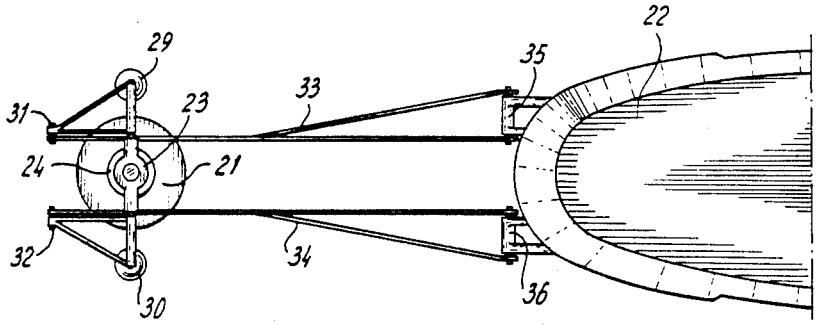
FIG. 10 is a top view of FIG. 8.

FIGS. 8, 9 and 10 relate to a preferred embodiment comprising a tower 21 connected to a vessel 22. The tower at the top has been provided with a support 23 rotatable about the diagrammatically indicated bearing 24 with vertical axis. Said support has horizontal pivot shafts 25 and 26 from which are supported spaced constructions 27 and 28 respectively each carrying a weight 29 and 30 respectively and at a location located further inwardly and beyond the vertical pivot axis of the bearing 24 have pivotal connections 31 and 32 respectively with the rigid connecting arms 33, 34 which are connected to the vessel 22 by means of horizontal pivot shafts 35, 36.

In the shown embodiment the weights and connecting points 31 and 32 respectively are above water. A connecting point and a weight respectively located below water level is, however, possible as well.

Figure 11:
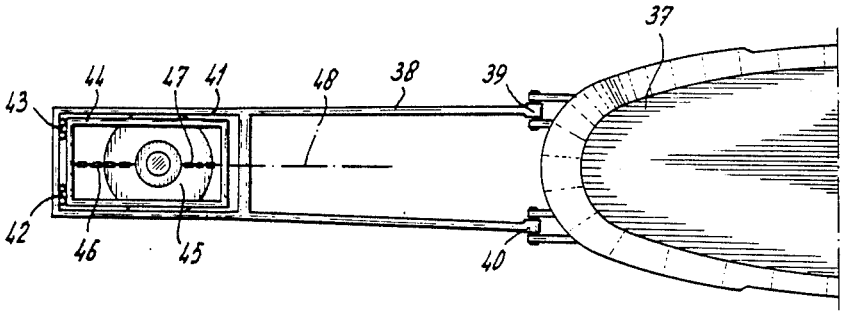
FIGS. 11 and 12 show top views of further changed embodiments.

In the embodiment of FIG. 11 a rigid arm 38 has been connected to the vessel 37 by means of pivots 39 and 40 with horizontal axis. Said rigid arm at its outer end has a rectangular frame portion 41 which at 42 and 43 by means of pivots with horizontal axis has been connected to the weight loaded construction 44, which in that case comprises a rectangular frame. This frame is suspended from the tower 45 by means of two chains 46 and 47 which are present in the vertical central plane of division 48.

Swinging movements of the vessel 37 about the longitudinal axis are transferred by the arm 38 to the weight carrying construction 44 and said frame does allow this by the fact that it has been suspended in the said central plane of division by means of only two chains.

Figure 13:
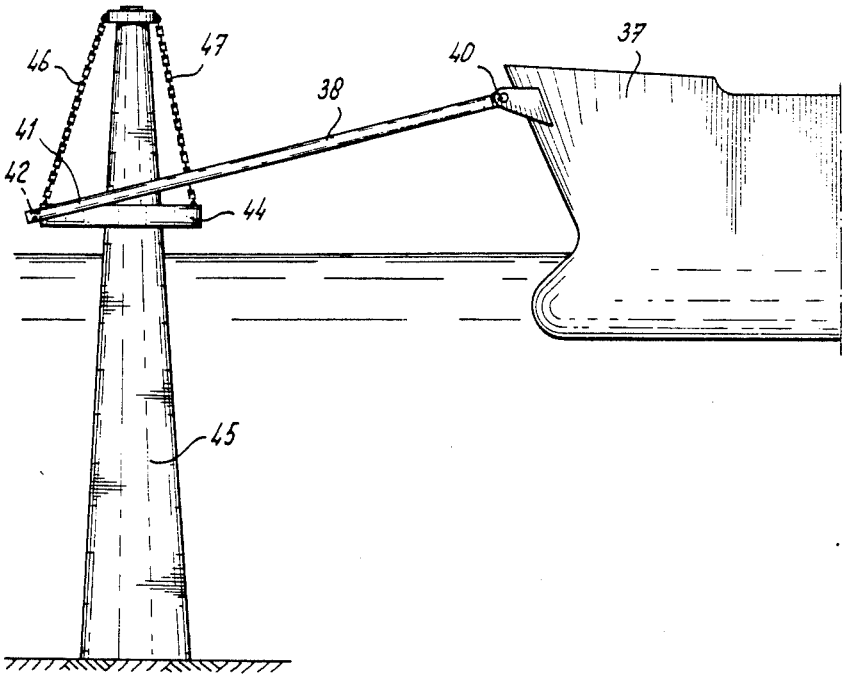
FIG. 13 shows the side view thereof.

FIG. 13 shows in side view the suspension with the chains 46 and 47

Figure 12:
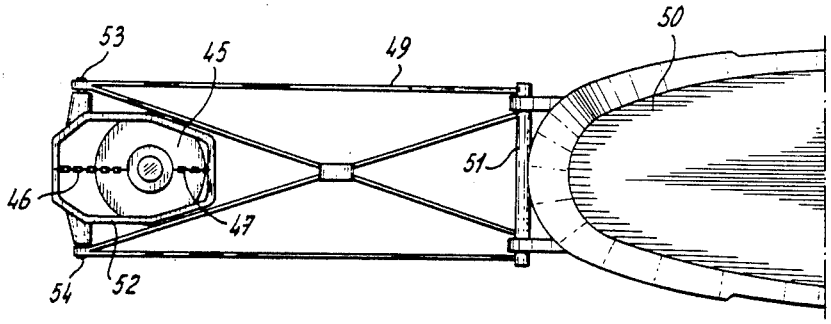

FIG. 12 discloses another construction of the rigid arm 49 connected with the vessel 50 by means of a single horizontal pivot 51 and with the weight-loaded construction 52 by means of two pivots 53 and 54 which extend parallel to the pivot 51. The frame of the construction 52 has been made in the form of an elongated polygon and the suspension from the tower 45 in this case takes places as well by means of two chains 46 and 47 respectively.

The embodiments according to FIGS. 8 to 13 inclusive show as well that the principle upon which the invention is based can be applied in many forms. All embodiments are shown as applied with a tower placed upon the bottom of the sea. The principle of the invention, however, can also be applied if the securement to the bottom of the sea is performed in a different way provided the connected construction is such that the larger freedom of movement is taken into account such as e.g. occurs with a buoy. This, however, is a matter of applying universal pivots where the connecting members are connected with the weight-loaded construction.

It is to be noted that in all of the embodiments described above, the point of connection of the connecting member on the ring, on the one hand, and the vessel, on the other hand, are located on opposites of a first imaginary vertical plane which includes the center of gravity of the ring and is perpendicular to a second imaginary vertical plane which includes the center of gravity of the ring and bisects the vessel.

We claim:

1. In a mooring device comprising a body (1) having a portion located at a distance above the bottom (2) of the body of water, which body is attached to said bottom (2) and has a support (4) which can rotate about a vertical axis and by means of downwardly extending elements (5) carries swingably about a horizontal axis a weight-loaded construction (6), which under the influence of its own weight has its center of gravity below its virtual point of suspension from the support (4), and a connecting member (7) between a vessel (3) and a point (8) of connection on said construction (6); the improvement in which said point (8) of connection on the construction (6) and the vessel (3) are located on opposite sides of a first imaginary vertical plane which includes the center of gravity of said construction (6) and is perpendicular to a second imaginary vertical plane which includes said center of gravity and bisects the vessel (3).

2. Mooring device as claimed in claim 1, in which the connecting member is a rigid arm.

3. Mooring device as claimed in claim 2, in which the connecting member comprises two rigid arms which independently of each other are pivotably connected to the floating device and to the construction.

4. Mooring device as claimed in claim 2, in which said construction is in the form of a closed ring, said downwardly extending elements being disposed in said second imaginary vertical plane.

5. Mooring device as claimed in claim 1, in which the construction comprises a ring which surrounds the body.

6. Mooring device as claimed in claim 1, in which the construction has the form of an open U or horse shoe with the opening turned away from the vessel.

7. Mooring device as claimed in claim 1, in which the construction on the same side as the vessel is loaded heavier than on the side at which the connecting member is attached.

8. Mooring device as claimed in claim 1, in which the support has two pivot shafts extending in opposite directions each of which carries a construction with a weight suspended from it and each construction is connected with the vessel by means of an own connecting member and said construction and connecting members can pivot independently of each other.

9. Mooring device as claimed in claim 8, in which each construction comprises an open frame, which starting from the plane of said pivot shafts has a portion carrying the weight as well as a portion in engagement with the connecting member, which portions are present in planes parallel to the axis of the pivots and spaced apart such that the pivot movements of the connecting member with respect to the construction remain free from the weight and the weight supporting portion.

* * * * *